United States Patent [19]

Roach

[11] 4,378,178

[45] Mar. 29, 1983

[54] OFFSHORE PLATFORM SYSTEM AND METHOD

[76] Inventor: Richard T. Roach, 19 E. Broad Oaks, Houston, Tex. 77056

[21] Appl. No.: 191,667

[22] Filed: Sep. 29, 1980

[51] Int. Cl.[3] ..... E02D 7/74; E02B 17/08; B63B 35/40

[52] U.S. Cl. ..... 405/224; 405/196; 405/209

[58] Field of Search ..... 405/196, 202, 203, 207, 405/209, 224; 114/258, 259, 264, 293, 242, 248

[56] References Cited

U.S. PATENT DOCUMENTS

| | | | |
|---|---|---|---|
| 2,210,408 | 8/1940 | Henry | 405/209 X |
| 2,612,025 | 9/1952 | Hunsucker | 405/209 |
| 2,986,889 | 6/1961 | Ludwig | 114/293 X |
| 3,031,997 | 5/1962 | Nesbitt | 114/293 |
| 3,078,680 | 2/1963 | Wepsala | 405/209 |
| 3,681,928 | 8/1972 | Vincken et al. | 405/196 |
| 3,996,754 | 12/1976 | Lowery | 405/203 X |
| 4,013,032 | 3/1977 | Bludworth | 114/248 |

*Primary Examiner*—David H. Corbin
*Assistant Examiner*—Nancy J. Pistel

[57] ABSTRACT

An offshore platform structure and a system for transport and for reversible erection is disclosed. The light weight, semi-mobile structure; has negative buoyancy; is free standing on the ocean floor; has fixed guylines below interference depth and quickly positioned upper guylines for storm conditions; the structure may contain suitable tanks in the base for production of marginal crude oil wells or other fluid storage; a special tender to furnish buoyancy during transport.

7 Claims, 13 Drawing Figures

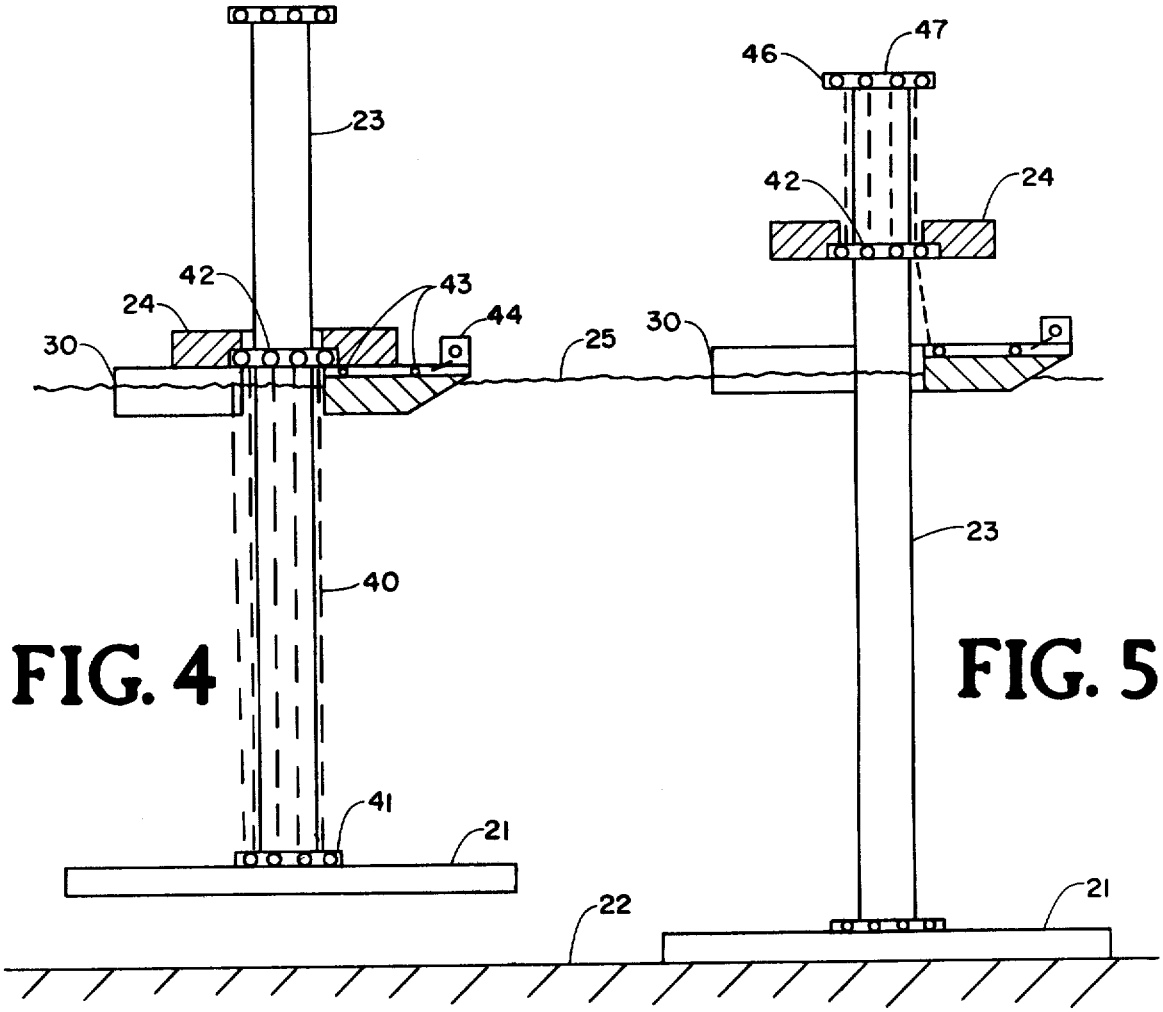
FIG. 4
FIG. 5
FIG. 6
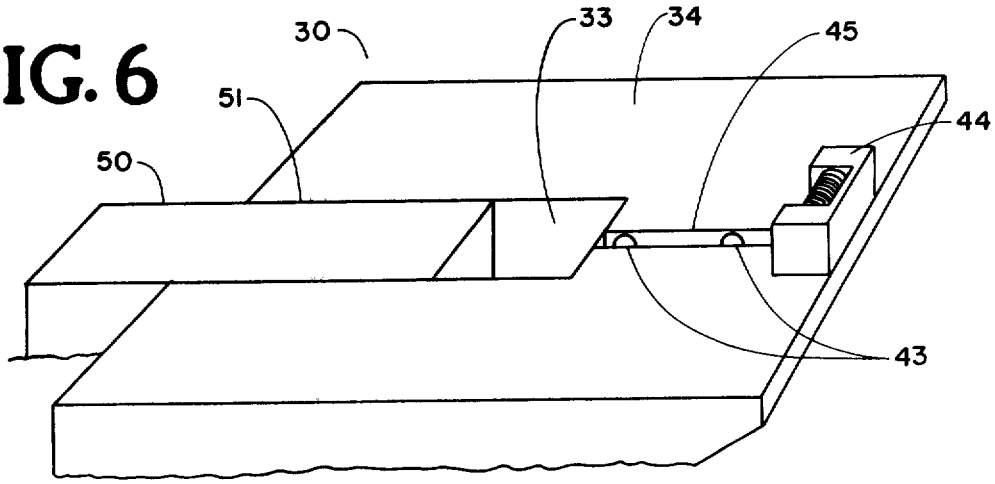

OFFSHORE PLATFORM SYSTEM AND METHOD

FIELD OF THE INVENTION

This invention relates to offshore structures used for: oil and gas exploration, drilling and production; industrial and commercial purposes; navigation; communication; and marine research. More particularly it relates to structures supported without piling by the ocean floor as opposed to floating platforms or to structures mounted on piling.

BACKGROUND OF THE INVENTION

The installed cost of conventional offshore permanent platforms has become a major deterrent to their use, running as high as a billion dollars as in the case of the C.O.G.N.A.C. platform installed directly in the Gulf of Mexico. In installing such a platform, the jacket is floated to the installation site on launch barges after which the jacket is launched to a floating condition. It is then positioned by a crane barge, flooded and sunk in place. Piling anchors are then driven with a crane barge, the jacket levelled and welded to the piling which are then grouted. The machinery deck is floated to the site on a deck barge and lifted into place on the installed jacket by a crane barge. Such a platform installation is considered to be permanent in the sense that, as a practical matter, it is not moved to another site after its usefulness at the installed site ceases. While machinery decks can and are moved from jacket to jacket and drilling decks are replaced by production decks, the piling used to anchor a jacket is practically impossible to remove due to grouting and hence jackets are salvaged on an extremely rare basis. However, since jackets must be removed when their use ceases, the common practice is to cut loose, tow to deep water and then to sink them.

On the other hand, mobile platforms which have their own flotation and propulsion systems are very suitable for purposes that require frequent movement from one site to another because their erection and transport costs are relatively small. However the daily cost of mobile platforms virtually exclude them from all applications except high risk, high return applications, such as oil and gas well drilling.

Therefore, there is need for a safe, easily transportable and affordable semi-permanent offshore platform. Such need includes temporary facilities during: the exploration for and early production of oil and gas; the early life of an oilfield; early warning systems for defense purposes; navigation installations; communication installations; marine research installations and previously uneconomical industrial and commercial application.

Therefore, a principal feature of this invention is to provide a system for the efficient transport and reversible erection of a safe but lightweight offshore platform structure.

Another feature of this invention is to provide means for the transport of the platform structure.

Another feature of this invention is to provide means for the safe and efficient erection of the platform structure.

Another feature of this invention is to provide anchoring and guying means that do not interfere with normal operation of the platform facilities.

Another feature of this invention is to provide emergency guying means that can be effected safely and quickly before and during storm conditions.

Another feature of this invention is to provide means to safely and easily position and lower the base member and the structural column to the ocean floor.

Another feature of this invention is to provide means to assemble additional sections of the column as may be required by deeper water locations or to lower the center of gravity during transport.

Another feature of this invention is to provide means to adjust the platform to a preferred height above the water surface.

Another feature of this invention is to provide a means to adjust the column to a vertical position if the base member is positioned on a non-level ocean floor.

Another feature is to provide a method for deploying and retrieving an anchoring system without necessarily using conventional service boats.

SUMMARY OF THE INVENTION

This invention comprises a novel system and means to provide: a safe, lightweight offshore platform structure for use at a plurality of successive sites; for safe transport of the structure that does not require auxiliary off-loading equipment such as barge cranes; a structure capable of safely withstanding storm conditions; a structure having means for adjustment for proper installation in a substantial range of water depths; a structure having provision for convenient removal and reinstallation of construction devices not required during platform use; for general use of the marine transport means after transport and erection of the structures; for efficient deploying and retrieving of anchors.

BRIEF DESCRIPTION OF THE DRAWINGS

FIG. 4 illustrates a means to controllably lift the base member and column to or from the ocean floor.

FIG. 5 illustrates a means to raise the platform from the transport vessel to a desired height along the column with the base member on the ocean floor so as to support the column.

FIG. 6 illustrates use of the second hull to partially fill the slot in the transport vessel.

DETAILED DESCRIPTION OF THE PREFERRED EMBODIMENT

Figure 1:
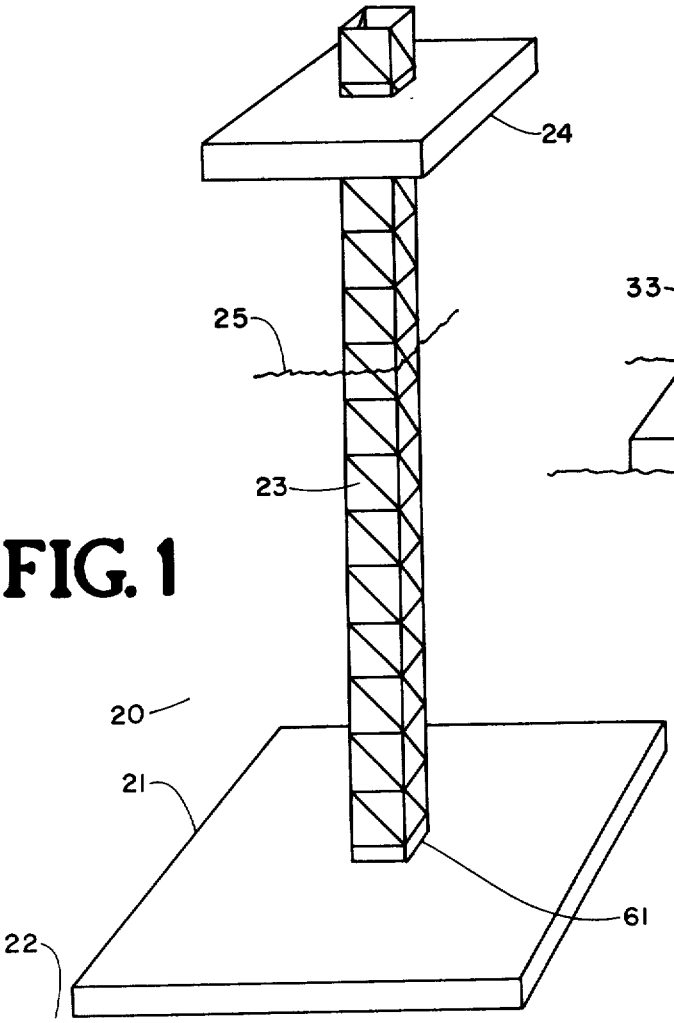
FIG. 1 illustrates the base member, column and platform in assembled position.

FIG. 1 shows the erected position of offshore platform structure generally at 20 having base member 21 bearing against ocean floor 22 so as to transfer the load from column 23 which was slidably positioned, as explained later, via adjustable attachment means 61, to the ocean floor. Platform 24 is affixed to column 23 at a convenient height above water surface 25, having been slidably positioned along column 23 as will be explained later. Column 23 is formed to minimize the effects of wind and wave forces on it during storm conditions and is sufficient to withstand the combination of forces such as structure weight, line loads and storm forces when guyed as explained later. Platform 24 may be designed in detail to suit a diversity of general usages, such as living quarters, drilling, compressor stations, petroleum processing and navigation aids, to name a few. Although column 23 is shown having a square cross-section, it may be any suitable cross-section.

Figure 2:
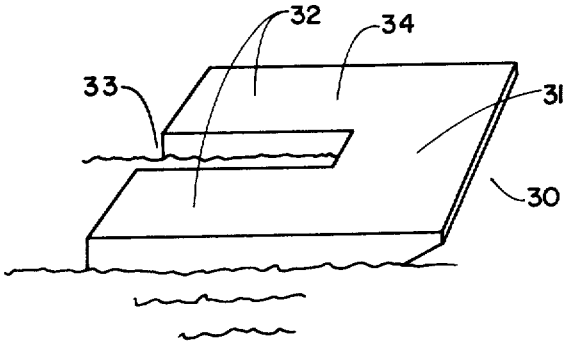
FIG. 2 shows the general configuration of the marine transport vessel having an open slot.

FIG. 2 illustrates the general configuration of the marine transport vessel as at 30, having end section 31 and side sections 32, which together from slot 33. Top deck 34 of vessel 30 is U-shaped, extending over the end section 31 and side sections 32. The width of slot 33 exceeds at least one lateral width of column 23 so that vessel 30 may be removably positioned with respect to column 23, such that sections 31 and 32 are adjacent column 23, column 23 then being within slot 33 and substantially at the center of buoyancy of vessel 30. The width of slot 33, being defined by the distance between side sections 32, is substantially less than the lateral width of platform 24, such that when column 23 is at the center of buoyancy of vessel 30 and when the bottom of platform 24 is lowered to the elevation of deck 34, vessel 30 will safely accept the load of the structure.

Figure 13:
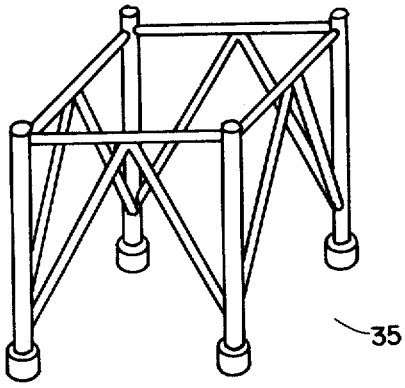
FIG. 13 illustrates a modular section of column 23.
Figure 3:
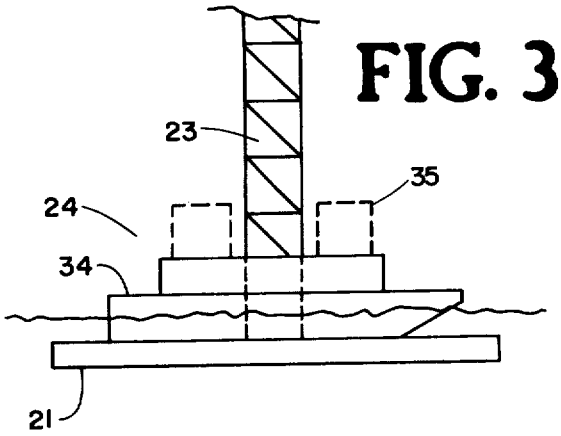
FIG. 3 illustrates the transport position of the transport vessel, the base member, the column and the platform.

As shown in FIG. 3, platform 24 may be lowered to rest upon deck 34 and column 23, with the base member 21 attached thereto, may be raised up through the platform 24 by means to be described later so as to effect the transport configuration for structure 20 and vessel 30 as shown in FIG. 3. Extra modular sections 35 of column 23 may be transported on platform 24 to lower the center of gravity of column 23 during transport and to be assembled as an upper part of column 23 by auxillary means, which may be included, removeably, in platform 24.

FIG. 4 illustrates a preferred arrangement for lowering or raising of the column and base member; column 23 being at the center of buoyancy of vessel 30; line 40 rigged through pulley assembly 41 which is releasably attached to base member 21, through pulley assembly 42 which is supported by deck 34, through suitable pulleys 43 which may be mounted in slot 45 in deck 34 or as convenient, through a heave compensator, if desired, and finally to winch 44 mounted on deck 34; such that takeup of line 40 onto winch 44 would cause the base member and column to rise with respect to platform 24 and vessel 30; letout of line 40 lowering the same. However, any suitable jacking system may be utilized; such as, for example, racks and pinions step jacks, etc.

FIG. 5 illustrates the preferred arrangement for raising or lowering platform 24 along column 23 when base member 21 is firm against the ocean floor as at 22; line 40 rigged through pulley assembly 46 which is releasably attached to the top section 47 of column 23; through pulley assembly 42 which has been lifted from deck 34 and which supports platform 24 while being raised or lowered, through pulleys 43, through a heave compensator, if desired, and finally to winch 44; such that takeup of line 40 onto winch 44 would cause platform 24 to slide upwardly along column 23 to the desired height above the water surface 25 and such that letout of line 40 would lower platform 24. After platform 24 is so raised and affixed to column 23 in any suitable manner, pulley assemblies 41, 42 and 46 may be removed for use elsewhere. For ease in their removal, the pulley assemblies may be arranged for removal in sections. The reeving of line 40 through the pulley assemblies is planned sufficiently in a conventional manner so as to gain proper balance of the load and sufficient mechanical advantage for the safe lifting of the structural members. However, any suitable jacking system may be used, as above.

As shown in FIG. 6, slot vessel 50 may be removably fixed by suitable means within slot 33 of vessel 30 as at 51 so as to clear column 23 and to add to the buoyancy of vessel 30 for transport of structure 20 as may be required due to superimposed loads on platform 24. When vessel 30 is not required for use in the transport of any structure as at 20, vessel 30 may be used for general transport of supplies, equipment and such. Vessel 50 may then be removably affixed to vessel 30 so as to fill slot 33 and effectively increase both the deck area and the total buoyancy available for general transport service.

Propulsion means may be in vessel 30 or vessel 50 or in both or provided by auxilliary means such as a tug boat, to the extent required for operation in a given locale. Thus vessel 30 may be fitted with the primary propulsion means for moving the entire structure in which case the vessel 50 may have a smaller propulsion means sufficient to propel itself. Alternatively, vessel 50 can be fitted with the primary propulsion means and vessel 30 may be unpowered. In either case, vessel 50 may be used to set anchors 81 and may be equipped with suitable winch means for lowering and raising an anchor after reaching a desired anchor location. This avoids the use of ancilliary boats for setting and retrieving anchors.

Figure 7:
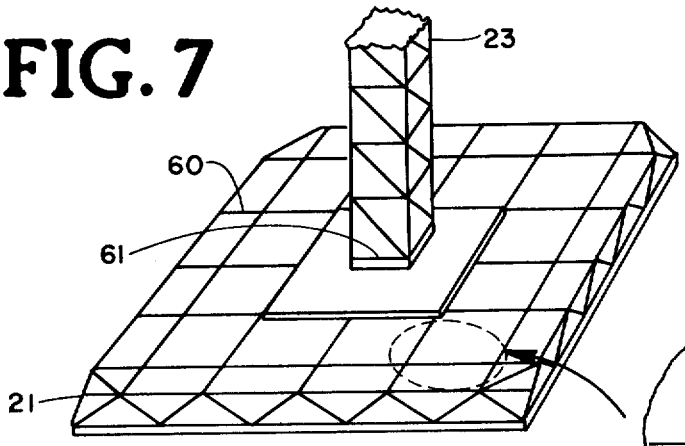
FIG. 7 shows a general construction of the base member.
Figure 8:
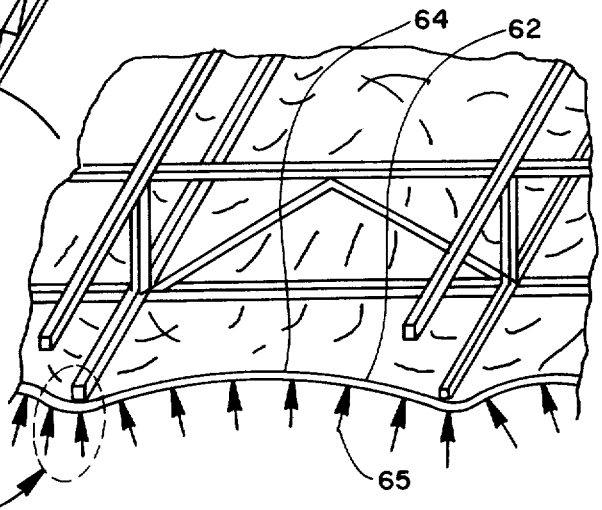
FIG. 8 is a fragmentary view, taken from FIG. 7, of a thin membrane acting against a soft ocean floor.
Figure 9:
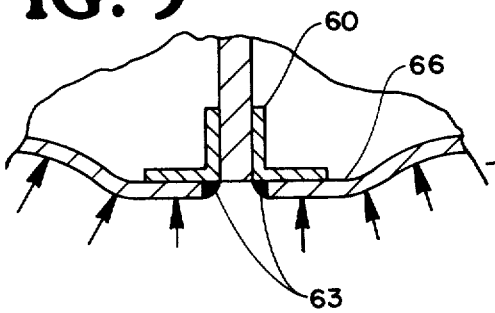
FIG. 9 is a fragmentary detail of attachment for the thin membrane; taken from FIG. 8.
Figure 10:
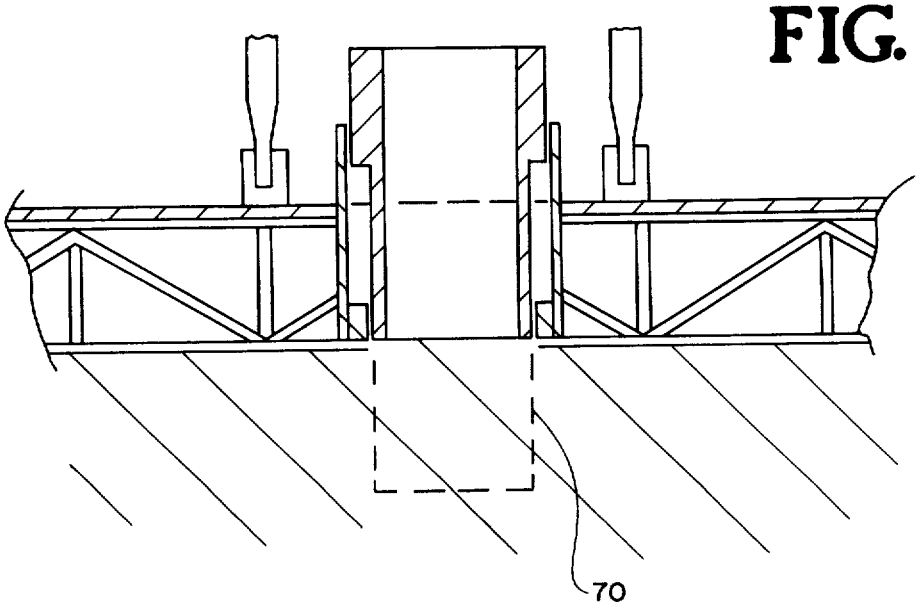
FIG. 10 illustrates the telescoping member in base 21.

Referring now to FIG. 7, base member 21 is shown in greater detail, having an open web frame 60 pivotably attached to column 23 at 61 by any suitable means, frame 60 being sufficient to generally distribute the load from column 23 to the ocean floor. Frame 60 is provided with a thin membrane 62 as shown in FIG. 8, membrane 62 being attached to frame 60 as by welds 63 of FIG. 9. Membrane 62 may be made of thin ductile metal plate so as to minimize the weight of the base member 21 without reducing its load carrying capacity. Membranes 62 may balloon upwardly as at 64 when acted upon by soft ocean floor as at 65, to thereby cause yielding of membrane 62 adjacent frame 60 as at 66 of FIG. 9, but without reducing the load capacity of base member 21.

If desired, base member 21 may comprise tanks which may be fitted with membrane internal partitions for fluid separation. The tanks may be interconnected with components mounted with the platform by means of pipes run within the column. Such tanks may be used for storage or floatation if required.

So as to prevent sliding of base member 21 along a soft ocean floor when acted upon by lateral forces, at least one open ended telescoping member 70 as in FIG.

10 may be retractably extended from the base member 21 so as to easily penetrate the soft ocean floor to thereby offer substantial resistance to lateral movement. Telescoping member 70 may be extended by any suitable means.

Figure 11:
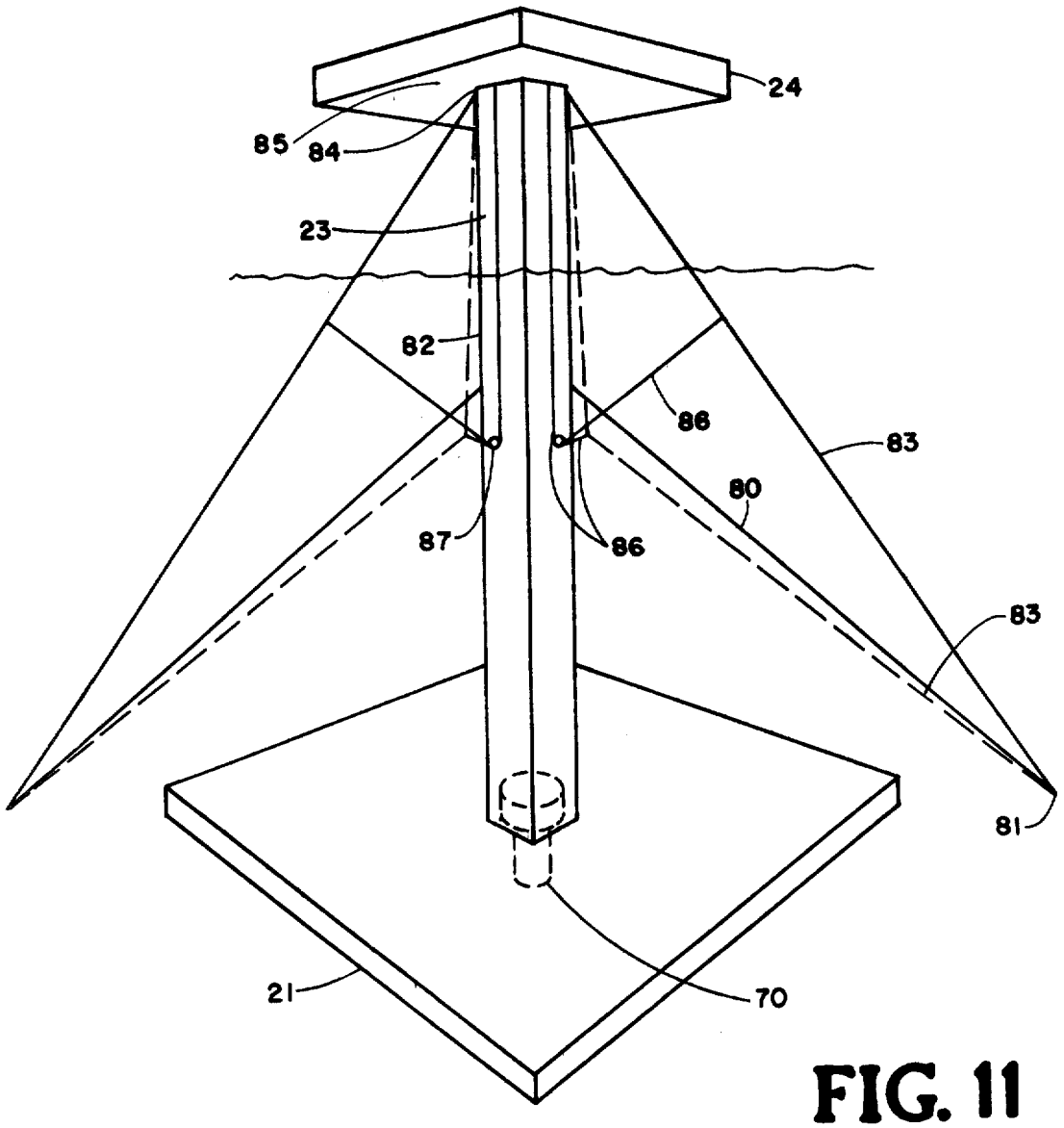
FIG. 11 depicts the guying and anchoring means used to stabilize the structure.

So as to resist forces generated against structure 20 by normal wind and ocean currents, lower guylines as at 80 are attached to anchors 81 secured to the ocean floor, the upper ends of lower guylines 80 of FIG. 11 being attached to column 23 as at least one elevation below interference depth 82, inter-ference depth 82 being the deepest of the draughts of vessels expected during erection or use of structure 20. Thus, lower guylines 80 together with telescoping member 70 act to maintain structure 20 in position during normal weather conditions and to stiffen the structure during storms.

When storm conditions are expected, normal operations of platforms are usually suspended and marine vessels are removed from offshore structures to prevent their crashing into the structure. Therefore, during storm conditions, upper guylines as at 83, if required, may be raised to a taut line position between anchor 81 and adjustable guyline attachment means 84 mounted within platform 24. Adjustable guyline attachment means 84 may be any suitable means such as a winch for tightening upper guylines 83 to the desired tension so as to quickly give proper lateral support to column 23, should storm warnings be given on a short notice.

So as to return to normal weather operating configuration, upper guylines 83 may be quickly returned to below interference depth by the reeling in of the stow line 86 and the reeling out from adjustable means 84 of the upper guyline 83. For that purpose, stow line 86 is rigged through pulley 87 attached to column 23 at a point below interference depth, one end of the stow line 86 being attached to upper guyline 83 such that the length of the upper guyline 83 from its point of attachment with stow line 86 to anchor 81 substantially equals the distance between anchor 81 and pulley 87, the other end of the stow line 86 being adjustably attached to winch 85 mounted within platform 24. Thereby, upper guyline 83 may be returned to stow position by reeling in stow line 86 on winch 85 and reeling out upper guyline 83 by means of adjustable attachment means 84.

Figure 12:
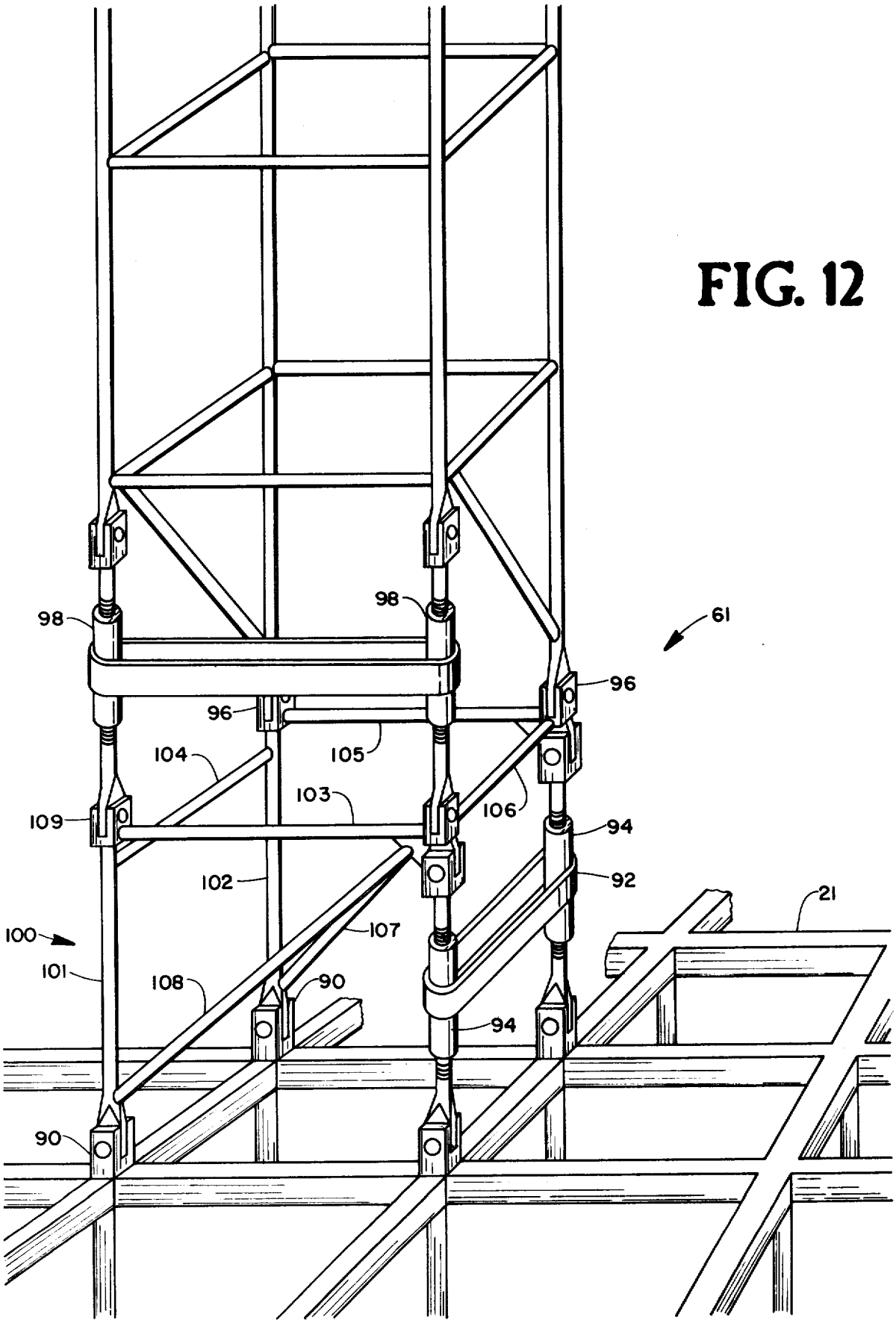
FIG. 12 illustrates means to adjust the column to a vertical position when the base member rests on a non-level ocean floor.

As shown in FIG. 12, pivotable adjustment means 61 may comprise hinges 90 at the base of column 23 so as to co-operate with turnbuckles 94 mounted on the opposite face of column 23 so as to cause column 23 to controllably pivot with respect to base 21, rotating on the axis of hinges 90. Turnbuckles 94 may be driven simultaneously by a conventional chain as at 92, chain 92 being driven as by a submersible motor, not shown, which may be controlled remotely from within platform 24.

So as to provide pivotable adjustment in a vertical plane of rotation disposed 90° from that afforded by hinges 90, a next higher pair of hinges as at 96 may be mounted 90° from the mounting of hinges 90 to thereby co-operate with turnbuckles 98 mounted on the opposite face of column 23. Turnbuckles 98 may be driven similar to the drive of turnbuckles 94, described above.

The lower pivot unit shown generally at 100, may be made strong and rigid by welding tubular members 101-108 together with hinge members as shown at 90, 96 and 109.

Column 13, being made controllably adjustable by the two sets of turnbuckles as described above, can thereby be adjusted to a vertical position, regardless of the direction of dip of the ocean floor and base 21 resting thereon.

OPERATION OF THE INVENTION

Beginning with transport configuration as shown in FIG. 3, structure 20 is transported to the desired site by means of marine transport vessels 30, and 50 if desired, and orientated with respect to true North as intended. With pulley assemblies 41 and 42 shown in FIG. 4 rigged with line 40 through pulleys 43 to winch 44, line 40 is allowed to slowly reel off of winch 44 so to lower the base and column to the ocean floor.

After weights of the base member 21 and column 23 have settled base member 21 firmly against the ocean bottom such that base member 21 assumes the same dip of the ocean floor, pivot adjustment means 92 and 93 are remotely actuated from platform 24 so as to adjust column 23 to a vertical position. Then vessel 50 may be detached from vessel 30 to set anchors 81 or auxilliary means may be used. Three or more anchors as at 81, each with a line 80, and 83 if required, attached thereto are then secured to the ocean floor in an appropriate pattern for site conditions and as well known in the art. Lower guylines 80 are then adjusted at the end adjustably affixed to column 23 at a point below interference depth 82, so as to maintain column 23 in a vertical position during normal weather conditions. Line 40 may then be re-rigged through pulley assemblies 42 and 46 for the lifting of platform 24. Modular sections 35, if used, may be installed by auxillary means to extend the normal height of column 23 at any suitable time during lowering of base member 21 or the raising of platform 24, as explained later or during both activities as may be required by the circumstances. With pulley assembly 46 assembled in place, winch 44 is then used to reel in line 40 which when rigged through pulleys 42 and 46 lifts platform 24 from deck 34 to the desired height on column 23. Platform 24 is then removably affixed to column 23 by shear pins or by other means well known in the art. Line 40 is then detached at its dead end and reeled up to be entirely located on marine transport vessel 30. Temporary pulleys 41, 42 and 46 may be removed and stored on vessel 30. Marine vessel 30 may be removed from the site by first detaching vessel 50 from within slot 33 of vessel 30 if vessel 50 is still in that position, and secondly by steering vessel 30 in the direction of end section 31 until side sections 32 no longer straddle column 23.

Line 83 is installed as shown by the dotted lines of FIG. 11 and thereby extending from anchor 81 to line 86 attached, to pulley 87 attached to column 23 below interference depth 82, and thence to adjustable guyline attachment means 84 mounted within platform 24, line 83 being out of the way of boat traffic. On brief notice of approaching storm conditions, line 83 is returned to storm position to further stabilize structure 20, by the reeling out of stow line 86 simultaneously with the reeling in of upper guyline 83 until guyline 83 is in a taut position between anchor 81 and platform 24.

When it is desired to transport structure 20 to another site for further use, the above procedure may be substantially reversed so as to return to transport configuration per FIG. 3.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interposed as illustrative and not in a limiting sense.

What is claimed is:

1. An offshore platform structure comprising: a base member sufficient to provide foundation support against the ocean floor; a single column extending upwardly from the base member; said column being of such length so as to extend from the ocean floor at the intended erection site to a desired elevation above the water surface; a platform slidably mounted around said column so as to allow controlled movement of the platform along the column; means for controllably sliding the platform along the column so as to adjust the platform height above the base; and means for reversibly affixing the platform to the column at a preferred height; said structure having negative buoyancy;

a plurality of anchors suitably spaced around the structure and attached to the ocean floor; a plurality of lower guylines, wherein one end of each lower guylines is attached to an anchor and the other end of each lower guylines is attached to the column below interference depth, interference depth being below the water surface sufficiently so as not to interfere with boats or the like; a plurality of upper guylines so stabilize the structure against storm conditions wherein one end of the upper guylines is attached to an anchor and the other end of the upper guylines is adjustably attached to the platform or column; and means for reversibly adjusting the upper guylines from a direct guying position between the anchor and the platform to a stow position, said stow position being from an anchor to a point near the column below interference depth and thence to the point of adjustable attachment to the platform or column.

2. The invention of claim 1 wherein the base member comprises: a frame extending laterally about the column a deformable membrane attached to the bottom of frame to transfer the structure load from the frame to the ocean floor.

3. The invention of claim 1, wherein said means for reversibly adjusting the upper guylines comprises: a stow line having one end attached to the upper guyline at a suitable distance along the upper guyline from the anchor; a stow pulley attached to the column below interference depth; the stow line passing through the stow pulley and thence the platform; such that the upper guylines may be loosened as the stow lines are tighened so as to quickly and controllably move the upper guylines between the stow position and the guying position.

4. The invention of claim 1 wherein: said means 4 controllably sliding the platform along the column are removable after the platform has been affixed to the column.

5. The invention of claim 2 wherein: said means for attaching the base member to the column are controllably adjustable, such that the column may be adjusted to a vertical position when said base member is positioned on a non-level ocean floor.

6. The invention of claim 2 wherein said means for adjusting the base member to the column comprise: the base member pivotably mounted on the column so as to allow the column to pivot toward any part of the base member periphery; means for controllably pivoting the column with respect to the base member; means for reversibly affixing the column with respect to the base member.

7. The invention of claim 2 further comprising: at least one open ended telescoping member capable of selectively telescoping out of the bottom of said base member and into the ocean floor so as to provide lateral support for the base member against lateral movement.

* * * * *